US011051636B2

(12) United States Patent
Sunesson et al.

(10) Patent No.: US 11,051,636 B2
(45) Date of Patent: Jul. 6, 2021

(54) GRAVITY FEED DISPENSER

(71) Applicant: HL DISPLAY AB, Nacka Strand (SE)

(72) Inventors: Oscar Sunesson, Stockholm (SE); Isak Åberg, Stockholm (SE); Mårten Sjöberg, Stockholm (SE)

(73) Assignee: HL DISPLAY AB, Nacka Strand (SE)

( * ) Notice: Subject to any disclaimer, the term of this patent is extended or adjusted under 35 U.S.C. 154(b) by 0 days.

(21) Appl. No.: 16/981,045

(22) PCT Filed: Mar. 14, 2019

(86) PCT No.: PCT/EP2019/056388
§ 371 (c)(1),
(2) Date: Sep. 15, 2020

(87) PCT Pub. No.: WO2019/179868
PCT Pub. Date: Sep. 26, 2019

(65) Prior Publication Data

US 2021/0106147 A1 Apr. 15, 2021

(30) Foreign Application Priority Data

Mar. 22, 2018 (EP) ..... 18163447

(51) Int. Cl.
*A47F 1/03* (2006.01)

(52) U.S. Cl.
CPC ..... *A47F 1/03* (2013.01)

(58) Field of Classification Search
CPC ..... A47F 1/03; A47F 1/035; A47F 1/10
See application file for complete search history.

(56) References Cited

U.S. PATENT DOCUMENTS 2,131,651 A * 9/1938 Woo ..... A47F 1/035 222/448
2,630,245 A * 3/1953 Maier ..... B65D 83/0409 221/264
2,919,051 A * 12/1959 Wideburg ..... A47F 1/10 221/131

(Continued)

OTHER PUBLICATIONS

Iris Carl; International Search Report, parent International Patent Application No. PCT/EP2019/056388, dated Mar. 29, 2019, European Patent Office, Rijswijk, Netherlands.

(Continued)

*Primary Examiner* — Donnell A Long
(74) *Attorney, Agent, or Firm* — Babcock IP, PLLC

(57) ABSTRACT

A container for holding and dispensing product has an upper inlet opening, a lower outlet opening and walls. Side walls and a downwardly sloping bottom wall defining an interior space for product. An outlet valve member is connected to a handle and arranged at the outlet opening for selectively allowing outward flow of the product through the outlet opening by manual operation of the handle. A body of the container has two mutually opposing first sidewalls, a second sidewall forming a rear wall and a forwardly sloping bottom wall. A front piece of the body forms a third side wall and is releasably fixed to a front portion of the body. The outlet valve member is connected to the handle by at least one cylindrical shaft received between a first semi circular recess arranged in the body and a second semi circular recess arranged in the front piece.

17 Claims, 10 Drawing Sheets

(56) References Cited

U.S. PATENT DOCUMENTS

| | | | | | |
|---|---|---|---|---|---|
| 4,194,647 | A * | 3/1980 | Spurrier | A47F 1/10 | 221/197 |
| 4,319,700 | A * | 3/1982 | Celender | A47F 1/10 | 221/312 R |
| 4,349,128 | A | 9/1982 | Sanfilippo | | |
| 4,526,292 | A * | 7/1985 | Waxman | A47F 1/10 | 221/131 |
| 5,375,744 | A * | 12/1994 | Henderson | B65G 65/4881 | 222/306 |
| 6,131,772 | A | 10/2000 | Robbins | | |
| 6,241,123 | B1 | 6/2001 | Elmore | | |
| 8,708,199 | B2 * | 4/2014 | James | A47F 1/02 | 222/158 |
| 8,870,024 | B2 * | 10/2014 | Mendes | A47F 1/03 | 221/204 |
| 10,450,152 | B2 * | 10/2019 | Brundick | B65D 47/261 | |
| 2005/0269366 | A1 * | 12/2005 | Brundick | A47F 1/03 | 222/185.1 |
| 2006/0266762 | A1 | 11/2006 | Andrews | | |
| 2011/0062190 | A1 * | 3/2011 | Johnson | A47F 1/035 | 222/517 |
| 2015/0276453 | A1 * | 10/2015 | Rusch | A47G 19/34 | 222/370 |
| 2017/0241824 | A1 * | 8/2017 | Rusch | G01F 11/006 | |
| 2018/0000261 | A1 * | 1/2018 | Smith | B65D 83/0876 | |

OTHER PUBLICATIONS

Borja Ibarrondo; European Search Report, counterpart European Patent Application No. 18163447.8-1101, dated Apr. 18, 2018, European Patent Office, Rijswijk, Netherlands.

* cited by examiner

GRAVITY FEED DISPENSER

FIELD OF THE INVENTION

The invention relates to a gravity feed dispenser for bulk material products. Within the food retail industry, such dispensers are often referred to as gravity bins.

BACKGROUND

Bulk material goods or products (hereinafter bulk products), such as grain, coffee, tea, nuts, spices, etc. are often sold by the weight in supermarkets and commodity stores. By this means, the customers are allowed to freely choose the desired quantity to purchase. There exist several different types of containers for storing, displaying and providing such bulk products to the customers in the stores.

One type is the so called scoop bins, at which the customers gain access to the bulk product via an openable lid and use a scoop to manually shovel goods from the container to a pouch, a bag, a jar or the like, which is brought to the check-out counter for weighing and paying. However, scoop bins entail certain disadvantages and problems. Since the outlet lid is openable, the bulk product stored in the container is exposed to contaminations from the surrounding atmosphere and from the customers. Additionally, the use of a scoop for manually transferring the goods from the scoop bin to customer's receptacle may cause considerable spillage, waste and littering in the store.

Another type of container for storing, displaying and providing bulk products is the so called gravity feed dispensers. These devices normally comprise a vertically oriented container having an upper closable inlet for filling and refilling and a lower outlet provided with a manually operable valve. The container is thus filled and refilled by store personnel having access to the upper inlet opening. Gravity acts on the bulk product stored in the container and urges it toward the lower outlet opening. The customer holds a bag, a pouch or other receptacle under the outlet and manually opens the valve, whereby the desired amount of the bulk product is poured by gravity into the customer's receptacle. At this type, the risk of contamination is greatly reduced since the bulk product stored in the container is not exposed to the surrounding atmosphere and since the outlet valve prevents the customers from getting access to the interior of the container. Additionally, pouring of the bulk product into a receptacle held beneath the outlet reduces the risk of spillage and the problems related thereto.

Containers for storing, displaying and providing bulk products should preferably exhibit some important qualities. Especially when they are used for storing foodstuff, the hygienic aspect is important. Thus, it is important that it is easy to wash and keep the interior of the container and other parts making contact with the bulk product clean. It should thus preferably be easy for maintenance personnel to disassemble and get access to the interior of the container. For the same reason it is important that the container exhibits a minimum of cavities, recesses or slits in which the bulk product or dust thereof may be caught. For economical reasons it is beneficial if the containers comprise a low number of constituent components and is easy to disassemble and reassemble. Also from a manufacturing point of view and for ascertain reliability and long service life, it is advantageous when the container comprises only a few constituent parts. At some applications it may be desirable to provide the dispenser with a so called "false front" which allows for clear and full display of the type and sort of stored bulk product also when the amount of stored product is running low.

PRIOR ART

U.S. Pat. No. 5,375,744 discloses a device for measuring and dispensing granular material, which device comprises a body member which defines a hopper with a discharge opening and a discharge port disposed below the discharge opening. A dispensing cylinder is rotably mounted in the body, between the discharge opening and port. The body also includes a removable top cover and a removable front cover.

U.S. Pat. No. 6,241,123 B1 discloses a bulk food dispensing apparatus comprising a bin exhibiting an upper opening for loading a bulk product and a lower opening. A rotating door which is operable by a handle is arranged at the lower opening for allowing the bulk product stored in the bin to flow under the force of gravity out through the lower opening. According to this document, the bin comprises a left side piece and a right side piece which are interconnected along a rear side and thereby form a first cavity. A front piece is connected to the left and right side pieces for securing these together and for defining a second cavity in front of the first cavity.

U.S. Pat. No. 6,182,864 B1 discloses a similar apparatus wherein the left and right side pieces are hingedly connected and secured by a front piece.

U.S. Pat. No. 8,870,024 B2 and U.S. Pat. No. 6,702,157 B2 disclose further examples of gravity feed dispensers comprising a container formed of two interconnected side pieces and a manually rotable gate or door for selectively blocking and allowing flow of a bulk product stored in the container through an discharge opening.

SUMMARY

An object of the invention is to provide an enhanced gravity feed dispenser for bulk products.

Another object is to provide such a dispenser which is easy to wash and clean.

A further object is to provide such a dispenser which comprises only a low number of constituent parts.

Yet another object is to provide such a dispenser which may easily be disassembled and reassembled by maintenance personnel.

A still further object is to provide such a dispenser which is reliable in use and has a long service life.

Another object is to provide such a dispenser which readily allows for the option to use the dispenser with or without a so called "false front".

A further object is to provide such a dispenser which alleviates the need to dismount and remove the dispenser from its normal operating position in a rack or the like, for allowing cleaning of the interior.

These and other objects are achieved by a gravity feed dispenser according to claim 1. The gravity feed dispenser is intended for storing, displaying and providing bulk products. It comprises a container arranged for holding the bulk product and comprising an upper inlet opening, an outlet opening and a plurality of walls. The walls comprise side walls and a downwardly sloping bottom wall, said walls defining an interior space for receiving the bulk product. A pivotal outlet valve member is connected to a pivotal handle and arranged at the outlet opening for selectively allowing and preventing outward flow of the bulk product through the outlet opening by manual pivotal operation of the handle. The container comprises a body and a front piece. The body comprises two mutually opposing first sidewalls, a second sidewall forming a rear wall and a forwardly sloping bottom wall. The front piece forms a third side wall and is arranged releasably fixed to a front portion. The outlet valve member is connected to the handle by way of at least one cylindrical shaft. The at least one cylindrical shaft is pivotally received between a first semi circular recess arranged in the body and a second semi circular recess arranged in the front piece.

The arrangement of the cylindrical shaft connecting the handle and the valve member and being pivotally received between recesses formed in the body and the front piece allows for a very simple and time efficient assembling and disassembling of the gravity feed dispenser. When disassembling the dispenser it suffices merely to remove the front piece from the body in a single operation to there by also to free and remove the valve member with handle. Correspondingly when re-assembling the dispenser it suffices to position the valve member with handle at the body and thereafter to re-attach the front piece to the body. By this means the time and effort needed for cleaning, washing and other maintenance is greatly reduced which enhances the probability that the high hygienic requirements posed when storing food stuff is met. The arrangement of the cylindrical shaft being received in recesses formed in the body and the front pieces also allows for a reliable pivotal fixation of the valve member with handle and reduces the number of constituent parts forming the gravity feed dispenser.

The outlet valve member may be connected to the handle by way of two cylindrical shafts, each shaft being pivotally received between pairs of first and second semi circular recesses arranged in the body and front piece respectively. Hereby the valve member and handle are journally fixed to the container at two separated positions which enhances the fixation, guidance and stability of the valve member, thereby reducing the risk of failure and wear.

The two cylindrical shafts may be arranged at opposing lateral ends of the outlet valve member. Hereby a symmetrical ab well balanced pivotal fixation of the valve member and handle is achieved.

The at least one cylindrical shaft may define the pivotal axis for the pivotal outlet member and the pivotal handle.

The pivotal outlet valve member and the pivotal handle are formed in one single integral piece forming a valve shutter. Herby the number of constituent parts is further reduced thereby further facilitating assembly and disassembly of the gravity feed dispenser.

The first semi circular recess or recesses may be arranged in a front edge of a first side wall of the body.

The second semi circular recess or recesses may be arranged in a rear edge of a first side wall portion of the front piece.

The body may exhibit an open front extending between front edges of the first side walls.

The open front extends over essentially the entire vertical length of the front edges of the first side walls.

The arrangement of a forwardly open body comprising side walls and a bottom wall in combination with a separate and detachable front piece allows for easy access to the interior space for washing the interior of the container. It suffices merely to remove the separate front piece and the valve member with handle to gain access to all other walls defining the interior space and thereby all interior surfaces that are in contact with the stored bulk product. The fully open front of the body further provides sufficient access to the interior of the container also when the body is kept in its normal operating position. Normally, several gravity feed dispensers are arranged side by side in rows and columns in a stand. At the previously known gravity feed dispensers it was required to first remove the containers from the stand in order to be able to open and gain access to the interior for washing. This rather time consuming and ergonomically disadvantageous operation is not necessary when preforming washing and other maintenance operations at the inventive gravity feed dispenser.

However, at an alternative embodiment, the body may comprise an auxiliary front wall, which together with the first and second side walls and the bottom wall defines a main compartment. By attaching the separate front piece to such a body, a second compartment forming a so called false front may be defined between the front piece and the auxiliary front wall of the body.

The body may be formed in one single integral piece of material. By this means the container is made up by only two main constituent parts, i.e. the body and the front piece. This reduces the number of joints between multiple parts, which joints may constitute caches for powder and debris originating from the bulk product. In addition, the two part constitution of the container reduces the number components needed to be manufactured and assembled.

At an alternative embodiment the body may be formed of two or more separate pieces such as e.g. two mirror symmetric half pieces which are joined together at a central longitudinal plane of the body.

The gravity feed dispenser may further comprise an intermediate wall which is releasably fixed to the body and arranged to divide the interior space into a rear compartment and a front compartment. By this means the user is given the option to readily convert the dispenser for use with or without a so called "false front".

The intermediate wall may exhibit a lower through opening and a hatch which is pivotally attached to the intermediate wall.

The gravity feed dispenser may comprise snap-fit means for releasably fixing the front piece to the body.

The snap-fit means may be arranged at an upper front portion of the first side walls and at an upper rear portion of the front piece.

Each of the body and the front piece may comprise cooperating chute portions, which together from an outlet chute arranged downstream of the outlet opening.

The chute portions may comprise female and male engagement means for form locking a lower portion of the front piece to the body.

The gravity feed dispenser may comprise a lid which is hingedly and removably fixed to an upper portion of the body for selectively closing and opening the inlet opening.

Further objects and advantages of the invention will be apparent from the following description of embodiments and from the appended claims.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1A:
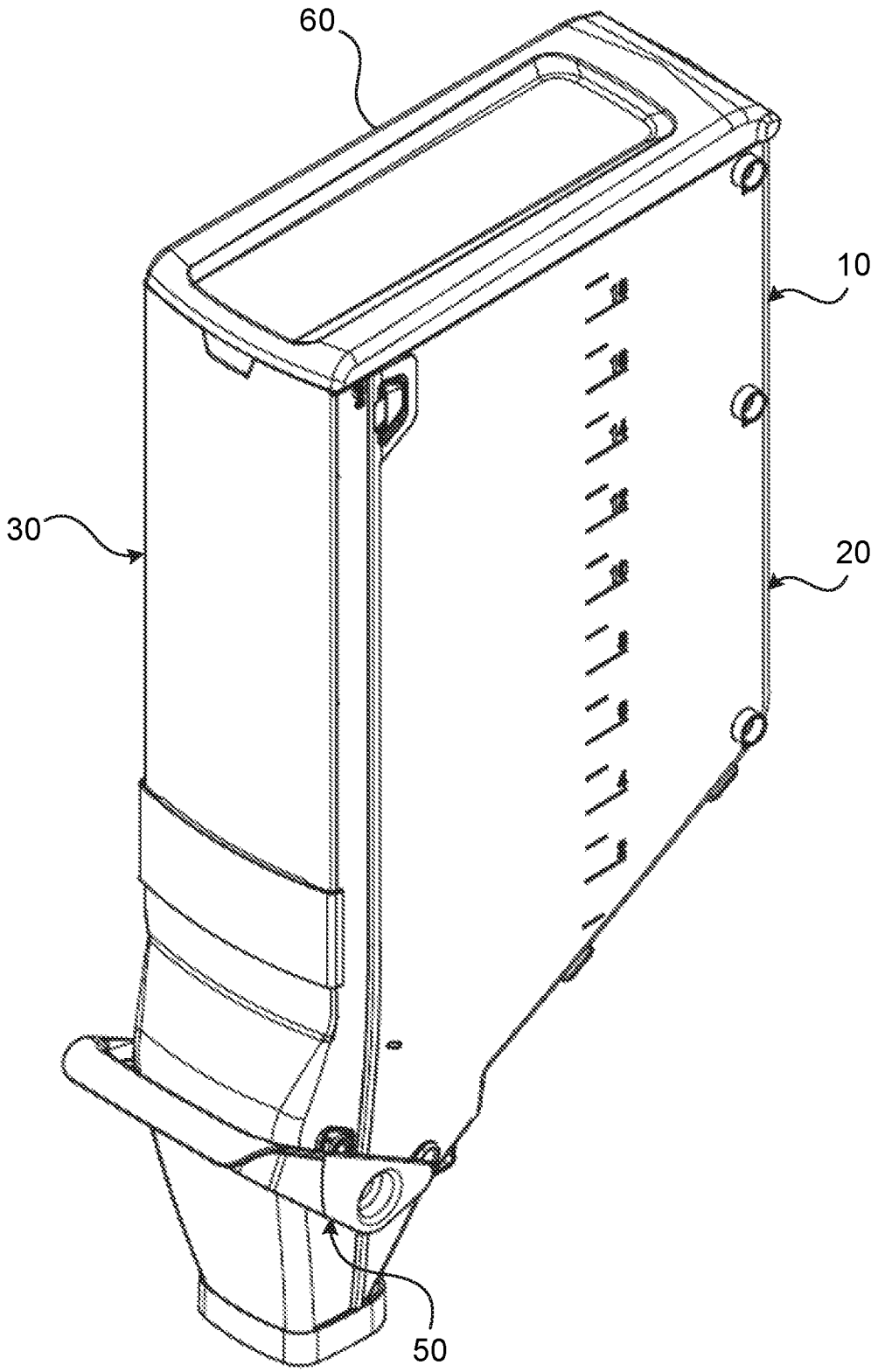
FIG. 1*a* is a perspective view of a gravity feed dispenser according to an embodiment of the invention and FIG. 1*b* is a corresponding view of the same dispenser with a lid in an open state.
Figure 1B:
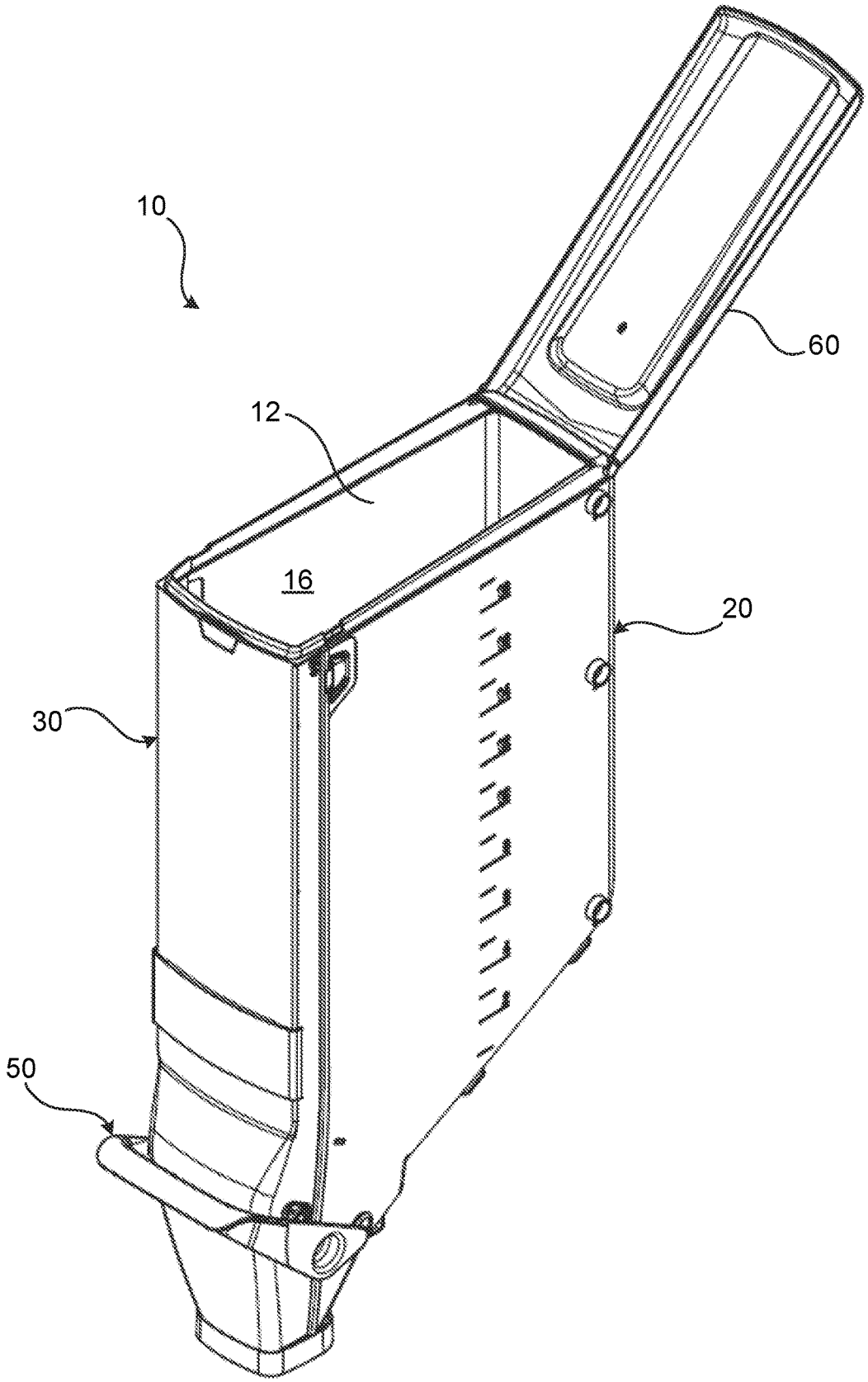
Figure 2:
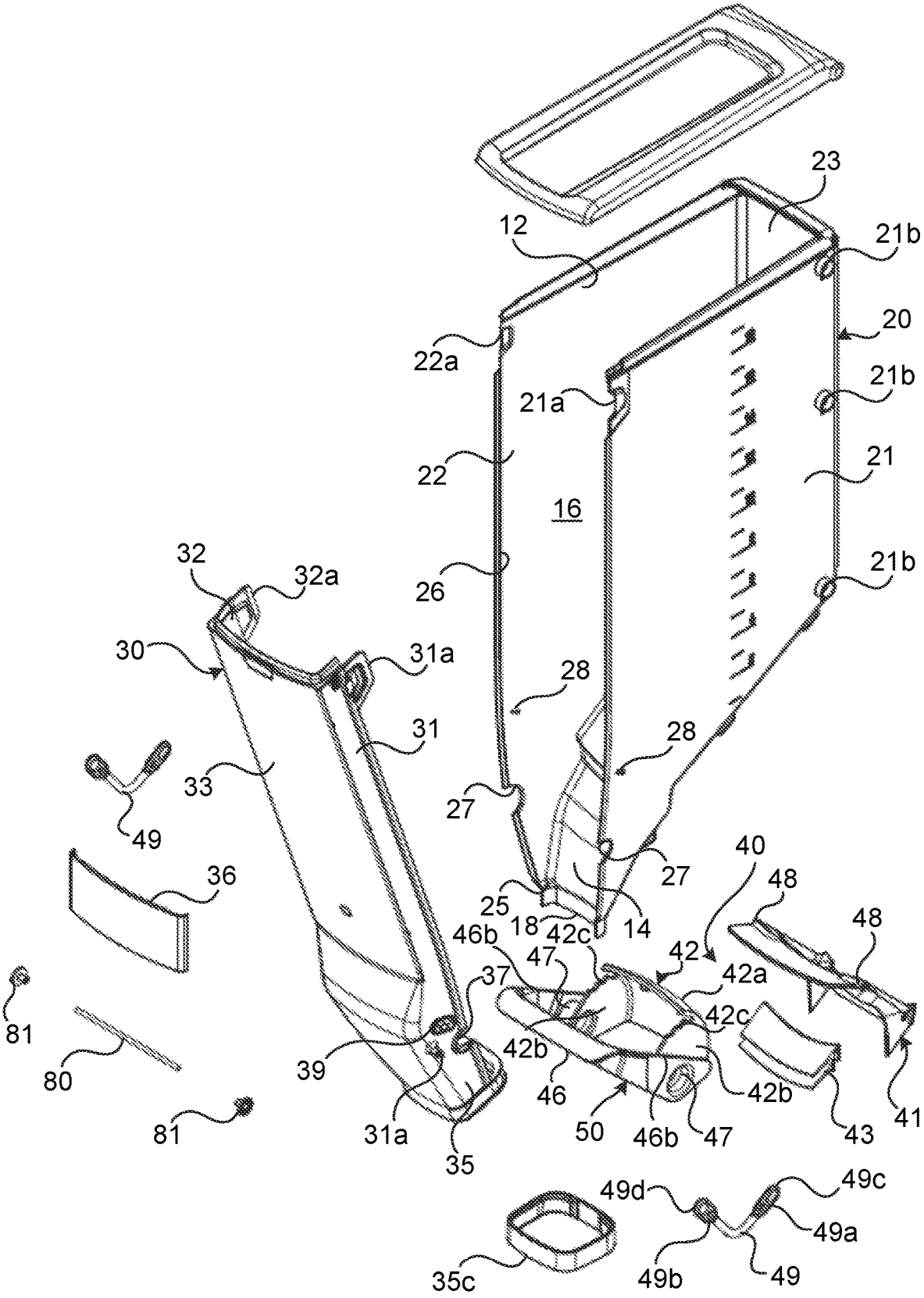
FIG. 2 is an exploded perspective view of the dispenser shown in FIGS. 1*a-b*.

The gravity feed dispenser shown in FIGS. 1*a-b* and 2 comprises a container 10 having an upper inlet opening 12 for loading bulk products into the container and a lower outlet opening 14 for dispensing a selectable amount of the bulk product into a bag or other receptacle (not shown) positioned under the outlet opening. The container 10 comprises two major components 20, 30 which, when assembled, define an interior space 16 for receiving and storing the loaded bulk product. One of these major components is constituted by a body 20 preferably formed as an integral single piece of material. In the shown example, the body has been formed by injection moulding of a durable transparent plastic material. However, other methods and materials for forming the one piece body may also be used. The other major component is constituted by a front piece 30 which is releasably mounted to the front portion of the body 20. In the shown embodiment also the front piece 30 is formed by injection moulding of a durable transparent plastic material but other methods and materials may be used.

At a not shown alternative embodiment, the body may comprise two or more separate pieces which are attached together when assembling the container. It may for example comprise two mirror symmetrical half pieces which are mutually snap-fitted or interconnected by other means for forming the body.

The body 20 comprises two first vertical sidewalls 21, 22 which are arranged mutually in parallel. A second vertical sidewall 23 forms a rear wall and extends between upper rear edge portions of the first sidewalls. A bottom wall 24 extends between the lower edge of the rear wall 23 and the lower edges of the two first sidewalls 21, 22. The bottom wall 24 slopes downwards in the forward direction from the rear wall 23 such that the bulk product received in the container 10 is urged by gravity toward the lower front portion of the container, where the outlet opening 14 is arranged. In front of the outlet opening 14, respective portions of the first sidewalls 21, 22 and the bottom wall 24 are arranged to form a downwardly directed first chute portion 25 having a generally U-shaped cross section. By this means the body 20 exhibits a completely open front 26 which extends over the entire height of the body 20. A number of mounting protrusions 21*b* are arranged laterally protruding at the rear portion of each first side wall 21, 22. These protrusions are arranged for mounting the gravity feed dispenser to a rack or stand (not shown) in a manner which is known per se. Normally the stand is arranged for receiving a plurality of gravity feed dispensers side by side in rows and columns.

The front piece 30 comprises a front wall 33 which constitutes a third side wall of the container 10 when the front piece has been mounted to the body 20. A first side wall portion 31, 32 extends rearwardly from respective lateral edges of the front wall 33. The rear edges of the first side wall portions 31, 32 are essentially equally long, in the vertical direction, as the front edges of the first side walls 21, 22 and provided with rearwardly open grooves (not shown) which receives respective front edges of the first side walls 21, 23 for secure mounting of the front piece 30 to the body 20. At the lower portion of the front piece 30 the front wall 33 and the two first side wall portions 31, 32 form a downwardly directed second chute portion 35 having a generally U-shaped cross section which corresponds to the cross section of the first chute portions. When the front piece 30 is mounted to the body 20, the first 25 and second 35 chute potions together define a tubular chute which is arranged to guide the dispensed bulk product from the outlet opening 14 to an exit port 18 of the container. A label holder 36 may be snap-fitted onto the front wall 33 of the front piece for holding a label (not shown) with information about the bulk product.

The gravity feed dispenser further comprises a valve arrangement 40 for selectively allowing and preventing flow of the bulk product from the interior space 16 through the outlet opening 14 to the outlet port 18. The valve arrangement 40 comprises a valve seat member 41, a pivotal valve member 42 and a flexible sealing 43. The valve seat member 41 exhibits a valve opening 44 and a partition wall 45 which is arranged at the outlet opening 14 of the container 10, such that the effective outflow area is reduced to the dimensions of the valve opening 44. The valve seat member 41 is attached to the body 20 by snap-fit means 28, 48 arranged at the first side walls 21, 22 and the lateral sides of the valve seat member 41.

In the shown example, the valve seat member 41 is formed by injection moulding a plastic material and the sealing is formed by injection moulding of a resilient material, such as a rubber material. Other methods and materials may be used as long as the sealing is formed of flexible and resilient material which remains in sealing contact with the pivotal valve member 42 during its pivotal movement. The sealing 43 comprises a base (not denoted) exhibiting a fixation channel 43 and two sealing lips 43*b* which extend in parallel from the base at the side being opposite to the fixation channel 43*a*. As best seen in FIGS. 6*a*-7*b*, the sealing 43 may be mounted to and dismounted from the valve seat member 41 when the valve seat member 41 is dismounted from the body 20. The sealing 43 is mounted to the valve seat body 41 by resilient formfitting of the fixation channel 43 around a valve seat bar 45*a* which delimits the valve opening 44. When the sealing 43 has been mounted to the valve seat member 41, these two components may be jointly snap-fit fixed to the body 20 by engaging the snap-fit means 48 of the valve seat body into corresponding snap-fit means 28 of the body 20. When so mounted, the valve seat bar 45*a* and a portion of the sealing 43 rest against a step 24*a* of the body 20 formed at the front edge of sloping bottom wall 24.

The pivotal valve member 42 exhibits an arced valve wall 42*a*, with which the flexible sealing lips 43*b* makes sealing contact. A valve bracket 42*b* connects each lateral side of the valve wall 42*a* to a respective cylindrical shaft 47, which shafts are axially aligned and define the pivotal axis for the pivotal valve member 42 and the valve wall 42*a*. The shafts 47 are in turn fixed to an operating handle 46 by means of which the valve member 42 and the valve wall 42*a* may be manually pivoted about its pivotal axis.

When mounted to the container 10, each shaft 47 is received in respective semi circular recesses 27, 37 formed in the opposing and engaging edges of the first side walls 21, 22 and the first side wall portions 31, 32. By this means the valve member 42 and the handle 46 are together pivotally journaled to the container when the front piece 30 is mounted to the body 20. The valve member 42, the shafts 47 and the handle 46 together form a valve shutter 50 which may be mounted to and dismounted from the container 10 as a single component. In the preferred embodiment shown, the valve shutter 50 is formed as a single integral piece of material, e.g. by injection moulding of a plastic material. However, other methods and materials for forming the valve shutter 50 are also possible.

Figure 4:
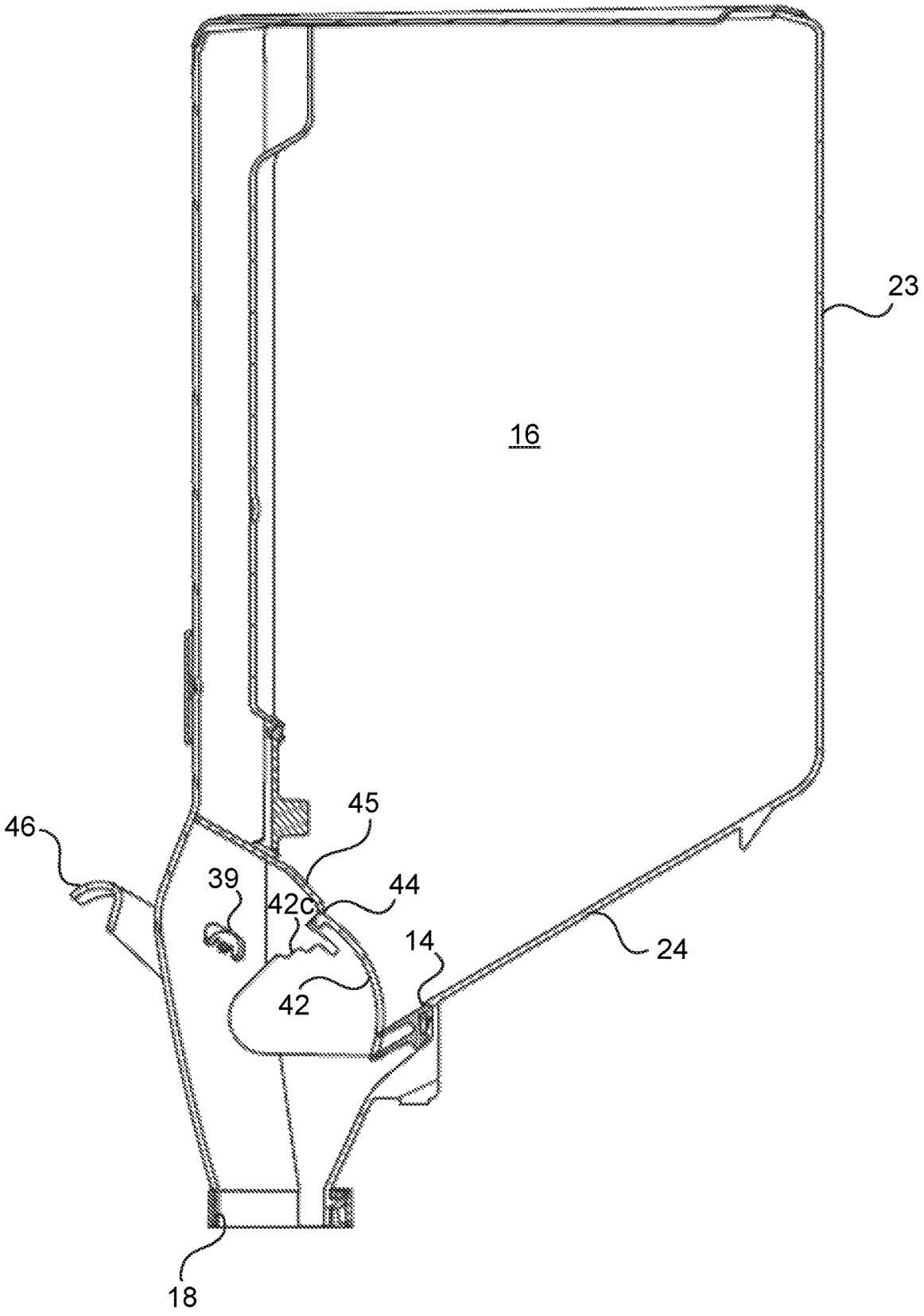
FIG. 4 is a vertical longitudinal section through the dispenser shown in FIG. 3.

The sealing 43 comprises two sealing lips that resiliently follows the surface of the valve member 42 during its pivotal movement. By this means also fine particles, such as powder and dust are also prevented from exiting the container when the valve member is in its closed position, as illustrated in FIG. 4.

Figure 8:
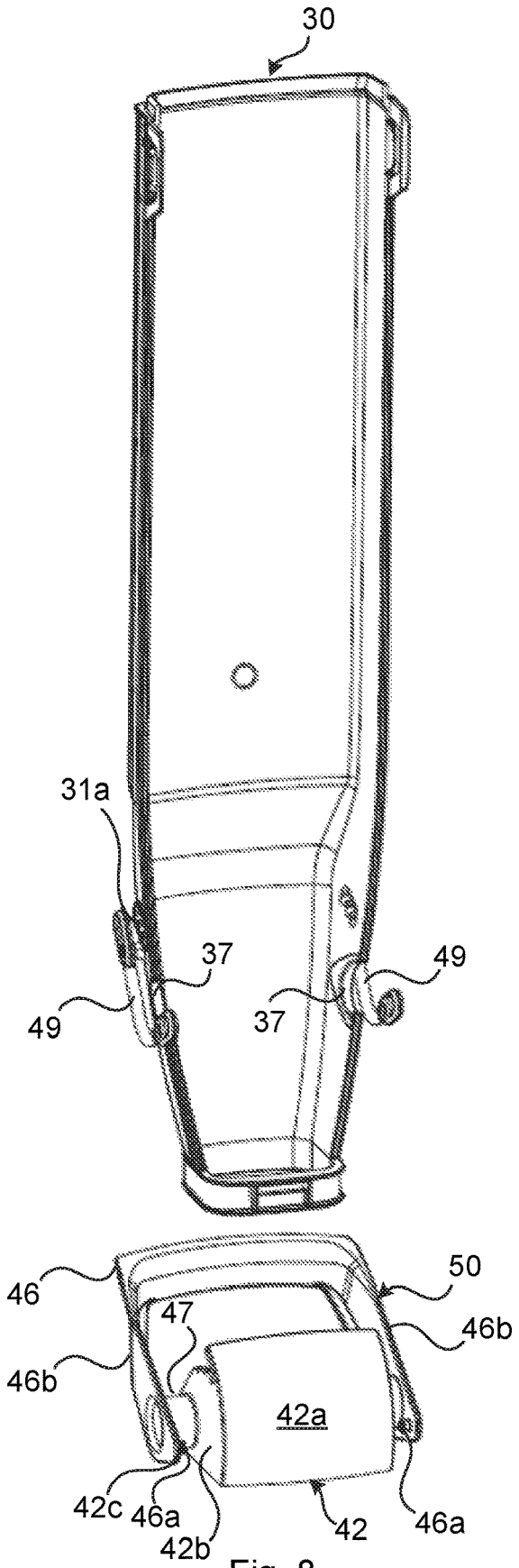
FIG. 8 is a perspective exploded view of a front piece and a valve arrangement of the dispenser shown in FIG. 2.

The valve arrangement 40 also comprises a biasing means for urging the valve member 42 and the handle 46 to its closed position when no opening force is applied to the handle. These means comprises an elastic string 49 arranged at each lateral side of the valve shutter 50. Both ends of each rubber string 49 exhibits a fixation aperture 49*a*, 49*b* and a grip 49*c*, 49*d*. One end of each string 49 is fixed to the valve shutter 50 by engaging a protruding peg 46*a* arranged at the distal end of a respective handle shank 46*b* into the fixation aperture 49*a*. The pegs 49*a* are positioned relative to the pivotal axis of the valve shutter 50, such that a tensile force in the elastic string generates a torque on the valve shutter, in the closing direction. The other end of each elastic string 49 is fixed relative to the front piece 30. This is accomplished by engaging a corresponding fixation aperture 49*b* onto a respective stud 31*a* which protrudes laterally at each lateral side of the front piece 30. In FIG. 8 it is illustrated how the one end of each string 49 has been attached to a respective stud 31*a* of the front piece 30. The valve shutter 51 may then be fitted to the front piece 30 by inserting the shafts 47 into a respective semi circular recess 37 at the rear edges of the front piece 30 and by engaging the fixation apertures 49*a* at the strings' other ends onto the respective peg 46*a* on the valve shutter 50. Once the valve shutter 51 has been so fitted to the front piece 30, the front piece and the valve shutter 50 may be snap fitted onto the body (as illustrated in FIG. 9*b*) whereby the shafts 47 are pivotally received between the semi circular recesses 27, 37 of the body 20 and the front piece 30. The valve shutter 50 is thus very easily mounted to and dismounted from the container 10 and still reliably held pivotally relative to the container and the valve seat member 41.

Figure 10C:
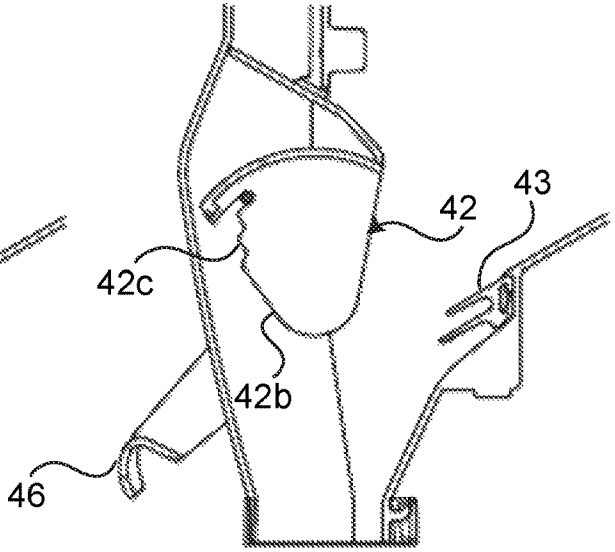
FIGS. 10*a-c* are longitudinal sections corresponding to FIG. 4 showing a detail of the dispenser in enlarged scale and illustrating respective maximum opening positions for the valve arrangement.
Figure 10B:
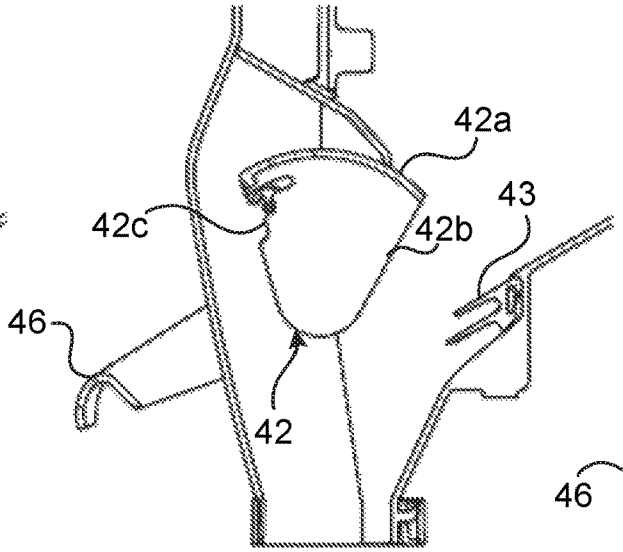
Figure 10A:
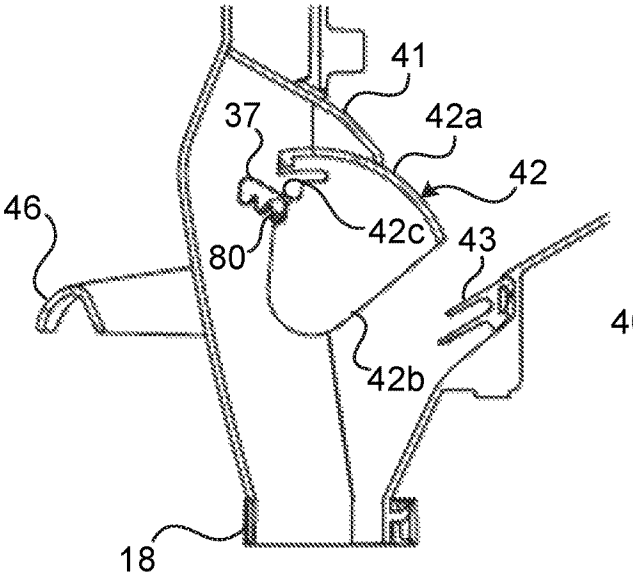

The valve arrangement 40 further comprises means for adjusting its effective maximum opening area. These means comprises a rod 80 which extends laterally through the front piece 30. Each first side wall portion 31, 32 is provided with an elongate through opening 39 which exhibits a number of adjustment slots arranged one after the other along the longitudinal direction of the elongate through opening 39. The rod 80 may be inserted into the elongate through openings 39 and its end portions may be positioned into a desired pair of adjustments slots. The rod 80 may thereafter be fixed in the adjustment slots by fixing a securing sleeve 81 onto each end of the rod 80. The valve shutter 50 exhibits a number of adjustment notches 42*c* formed in an edge of the valve member's 42 brackets 42*b*, one after the other in the pivotal direction of the valve shutter 50. Depending on the adjustment position chosen for the rod 80 in the elongate through openings 39, only one notch 42*c* at each bracket 42*b* will make contact with the rod 60 when the valve shutter 50 is pivoted in its opening direction. This contact between a notch 42*c* and the rod 80 blocks the valve shutter from further pivoting in the opening direction and thereby defines the selected fully opening area of the valve opening 44. In FIGS. 1*a*-*c* it is illustrated how the rod 80 has been engaged in different pairs of adjustment slots in the elongate through openings 37 to thereby define respective maximum valve opening areas. In FIG. 10*a* the rod 80 has been positioned in the rearmost adjustment slot (the right-most slot as seen in the figure). When so positioned the rod 80 will make contact with the front-most notch 42*c* (the left-most at seen in the figure) when the valve shutter is pivoted in its opening direction (counter clock wise as seen in the figures). The contact between the rod 80 and this notch 42*c* will thus appear after a comparatively small pivotal angle thereby defining a comparatively small maximum opening area. In FIG. 10*b* the rod 80 has been positioned in an intermediate adjustment slot of the elongate through opening 39, whereby an intermediate notch 42*c* will make contact with the rod 80 upon pivotal opening. Hereby a medium size maximum valve opening area is defined. In FIG. 10*c* the rod has been positioned in the front-most adjustment slot and will make contact with the rearmost notch 42 to thereby define a largest maximum valve opening area.

Such easily accomplished adjustment of the maximum valve opening area is very useful when the gravity feed dispenser is to be used for bulk products having different particle sizes and density, and where it is necessary to adjust the dispensing flow rate.

Figure 7A:
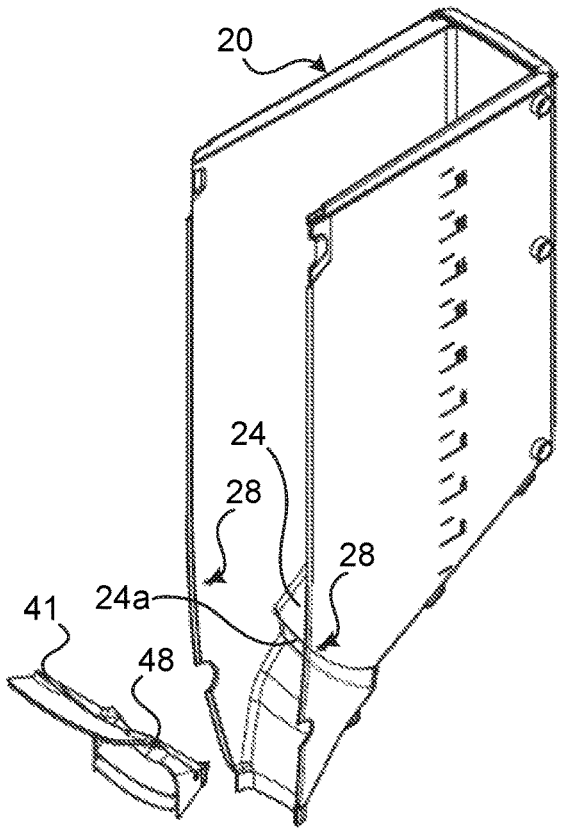
FIGS. 7*a* and 7*b* are perspective views of the assembled components shown in FIG. 6*b* and illustrate respectively these components when dismounted from and mounted to the body of the container shown in FIG. 2.
Figure 7B:
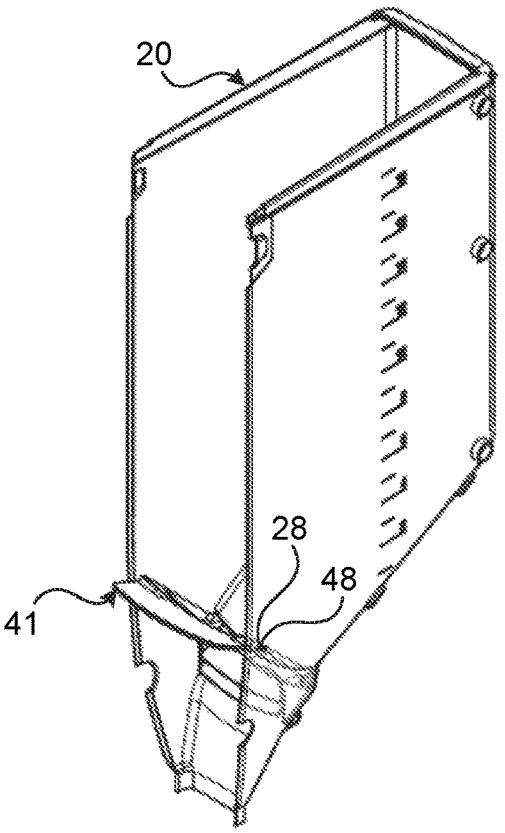
Figure 9A:
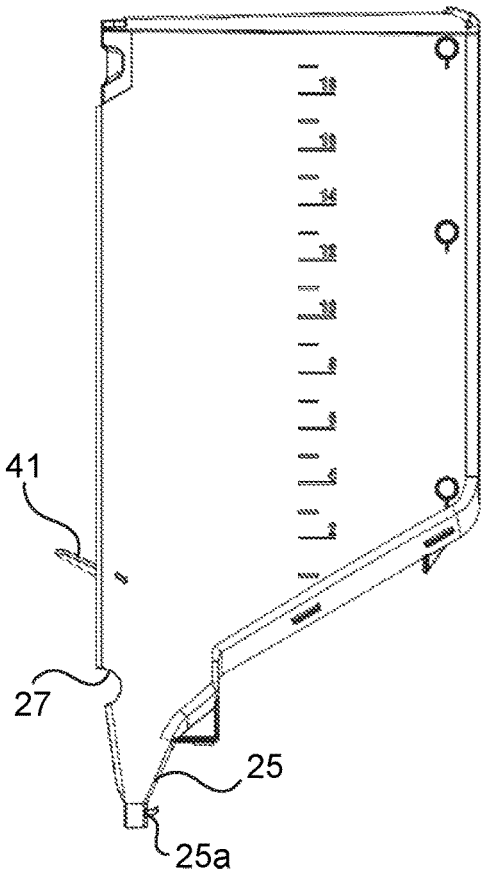
FIG. 9*a* is a side view of the body of the dispenser shown in FIG. 2
Figure 9B:
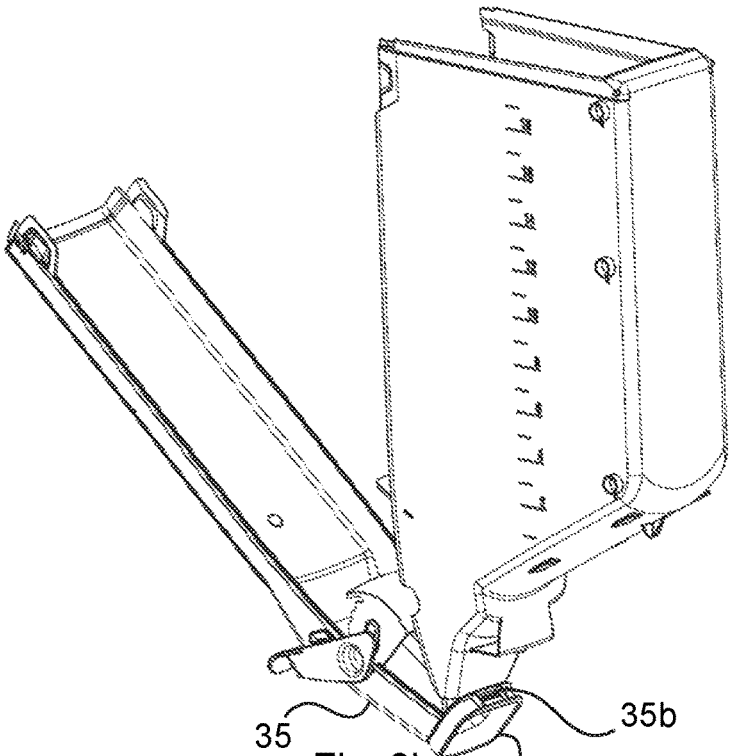
FIG. 9*b* is a perspective view of said body when a front piece and a valve arrangement is being mounted to the body for forming the container.

In FIGS. 9*a*-*b* it is illustrated how the front piece 30 is easily releasably fixed to the body 20 by snap-fitting. As seen in FIG. 9*a*, the valve seat member 41 has been mounted to the body 20 as shown in FIGS. 7*a*-*b* and described above. The body 20 comprises a protruding hook 25 which extends rearwardly from a lower rear portion of the first chute portion 25. As seen in FIG. 9*b*, the front piece 30 comprises a hollow collar 35*a* which extends rearwardly from the lower edge of the second chute portion 35. A through opening 35*b* is provided at the rear side of the collar.

The body 20 further comprises laterally protruding first snap-fit means comprising bulges 21*a*, 22*a* arranged at the upper front edges of side walls 21, 22. The front piece 30 comprises corresponding second snap-fit means 31*a*, 32*a* arranged at the upper rear edges of first side wall portions 31, 32. In the shown example these second snap fit means each comprise a tongue which is insertable inside a respective bulge 21*a*, 22*a* and a resilient hollow tab which is arranged to receive a respective bulge 21*a*, 22*a* by snap-fitting around the bulge.

As best seen in FIG. 9*b* the front piece 30, with the shutter valve 50 mounted (as illustrated in FIG. 8 and described above) is very easily relaeasbly fixed to the body 20. The upper end of front piece 30 is first tilted away from the body 20 and the lower end of the first chute portion 25 is introduced into the hollow collar 35*a* of the front piece 30. Thereafter or simultaneously, the hook 25*a* is inserted and engaged with the through opening 35*b* in the collar 35*a*. When so engaged the upper portion of the front piece 30 is pivotally tilted toward the body until the two tongues are inserted inside the bulges 21*a*, 22*a* and the hollow tabs snap around the periphery of the bulges 21*a*, 22*a*. By this means the front piece 30 is securely and releasably fixed to the body at the same time as the shutter valve 50, the valve seat member 41 and the seal 43 are locked in position. When the front piece 30 has been mounted to the body 20 a friction sleeve 35*c* may be threaded onto hollow collar 35*a*. The friction sleeve 35*c* may assist in holding the mouth of a pouch, a bag or the like when dispensing the bulk material from the gravity feed dispenser.

Figure 5A:
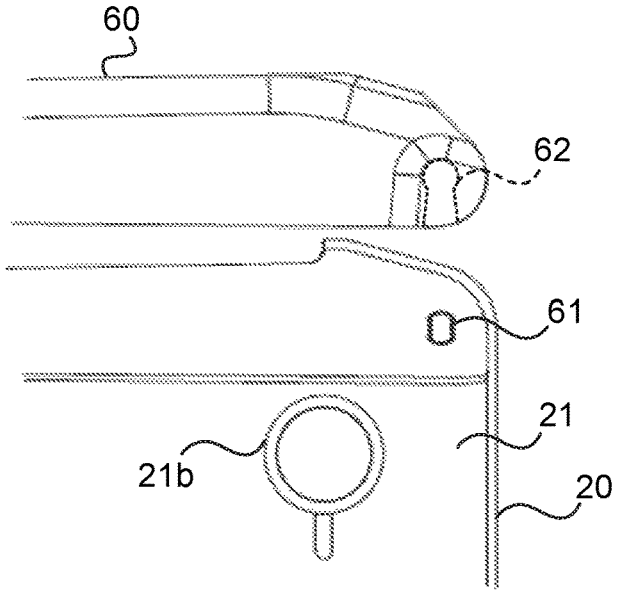
FIGS. 5*a-c* are lateral plan views in enlarged scale illustrating details of the dispenser shown in FIG. 3 with a lid positioned and oriented in different positions.
Figure 5B:
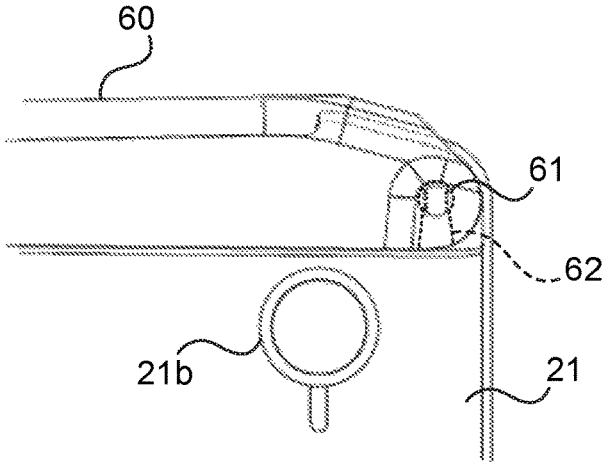
Figure 5C:
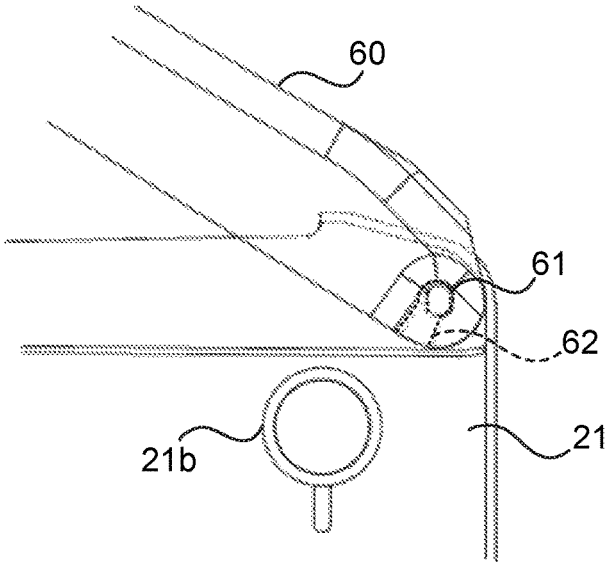
Figure 6A:
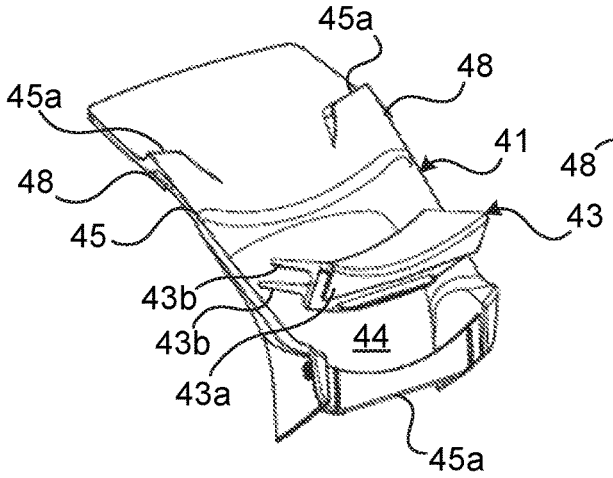
FIGS. 6*a* and 6*b* are perspective views of two components of the dispenser shown in FIG. 2 and illustrate these components when mutually disassembled and assembled respectively.
Figure 6B:
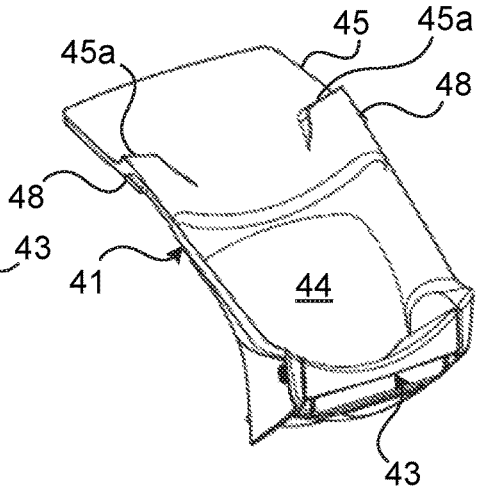

The gravity feed dispenser further comprises an openable lid 60 which is arranged to close the upper inlet opening 12 of the container 10. At a preferred embodiment illustrated in FIGS. 5*a-b*, the lid 60 and the body 20 comprise cooperating hinge means which permit the lid to be opened either by pivoting the lid as illustrated in FIG. 1*b* or by completely removing the lid 60 from the container 10. These hinge means comprises a peg 61 which protrudes laterally outwards from an upper rear portion of each first side walls 21, 22. The peg 61 has a vertically elongate cross section with straight side edges and rounded upper an lower edges. The lid 60 is provided with corresponding laterally inwardly facing recesses 62 having downwardly open key hole shape. FIG. 5*a* illustrates how the lid 60 is mounted to the container 10. The lid 60 is first oriented generally horizontally such that the lower mouth of the key hole recess 62 on both sides of the lid is aligned with the corresponding peg 61. Thereafter the lid 60 is displaced downwardly such that the pegs 61 are received in the respective recess 62. The lid may thus easily be mounted to and removed from the container as long as the lid is kept in a horizontal orientation. When the lid instead is opened by pivoting, form-locking between the peg 61 with elongate cross section and the key hole recess 62 prevents the peg 61 from being removed from engagement with the key hole recess 62, thereby preventing removal of the lid during such pivotal opening of the lid 60.

The gravity feed dispenser may very easily be completely disassembled simply by lifting of the lid 60, releasing the hollow tabs from the bulges 21*a*, 22*a*, pivoting the upper portion of the front piece away from the body 20 and thereafter releasing the hook 25*a* from the through hole 35. When the front piece 30 has been detached, the shutter valve 50 may be released by grabbing the grip portions 49*c*, 49*d* of the elastic strings 49 and releasing the strings 49 from the studs 31*a* and the pegs 46*a*. Correspondingly the valve seat member may easily be removed by disengaging snap means 28, 48, pulling out the valve seat member 41 from the body 20 and thereafter removing the seal 43 from the valve seat member 41. If needed the rod 80 may be easily be removed by releasing one fixation sleeve 81 and withdrawing the rod 80 from the opposite end.

Thus, by only a very few and simple manual operations, the entire gravity feed dispenser may be completely disassembled into its constituent parts whereby washing, flushing and other maintenance is greatly facilitated. Additionally, by simply removing the lid 60, the front piece 30 and the valve seat member 41 from the body 20, the body becomes completely open in the forward and upward direction whereby all interior walls of the body are easily accessible for washing and flushing. The low number of constituent part also allows for that the assembled gravity feed dispenser exhibits only a low number of component joints, thereby reducing the risk of fine particles and dust to be caught and collected in such joints.

Figure 3:
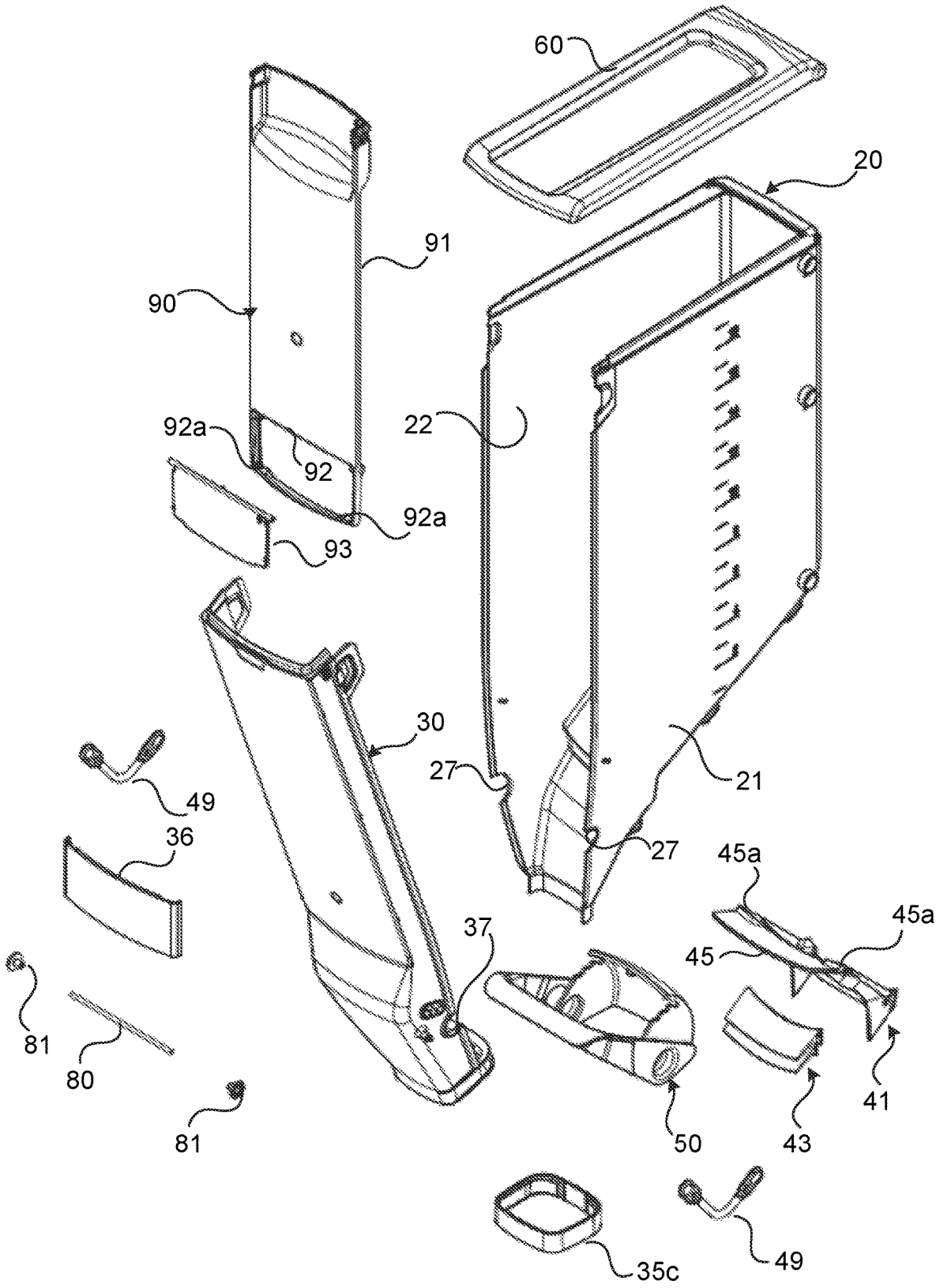
FIG. 3 is an exploded view of the dispenser shown in FIGS. 1*a-b* complemented with an additional intermediate wall.

FIG. 3 illustrates a gravity feed dispenser according to another embodiment. At this embodiment the body 20, the front piece 30, the valve seat member 41 and the valve shutter 50 are identical with those components of the embodiment shown in FIG. 2. At the embodiment shown in FIG. 3 however the gravity feed dispenser has be complemented by an removable intermediate wall piece 90. The intermediate wall piece 90 may be used for forming a so called false front, when so desired.

The intermediate wall piece 90 comprises a generally flat wall portion 91 with a lower through opening 92 and a pivotal hatch 93. As indicated in FIG. 3, the front edges of the first side walls 21, 22 of the body 20 are stepped such that both the rewardly and the laterally facing edge surfaces of the intermediate wall piece 90 are supported by the body's front edges. When the intermediate wall piece has been inserted between the front most, wider portions of the body's front edges, the front surface of the wall portion 91 is flush with the front most edge portion of the body's 20 first side walls 21, 22. By this means the intermediate wall piece may be positioned at the front opening of the body without hindering that the front piece 30 is releasably fixed to the body by lower from locking and upper snap-fitting as described above with reference to the embodiment shown in FIG. 2 et al. By such fixation of the front piece 30 to the body 20, the intermediate wall piece 90 is secured in position relative to the body 20 and the front piece 30. At its lower edge, the intermediate wall pieces is supported by the valve seat member 41 and two upper stop projections 45*a* arranged at the valve seat member's 41 partition wall 45.

The hatch 93 is, at its upper edge provided with laterally extending pins which engage corresponding recesses arranged at the inner edges of the lower though opening 92 such that the hatch may pivot about an upper horizontal and laterally extending pivot axis. At the lower edge of the through opening, stop lugs 92*a* are provided for making contact and hindering the hatch when it pivots passed the fully closed vertical position.

When the intermediate wall piece 90 and the front piece 30 have been fixed to the body 20 as described above, the intermediate wall piece 90 divides the interior space of the container into a main rear compartment arranged behind the intermediate front piece 90 and a smaller front compartment arranged between the intermediate wall piece 90 and the front piece.

For allowing full and clear display of e.g. which type, size and colour of bulk product that is stored in the gravity feed dispenser a major amount of bulk material may be filled into the rear compartment. There after, a limited amount of the bulk product may be filed into the front compartment. Both compartments may be filled through the inlet opening 12 which extends essentially over the entire horizontal depth of the container 10. Just as at the previous described embodiment the front piece is formed of a transparent material such that the bulk product received in the front compartment is clearly visible through the front piece 30.

If the hatch 93, when filling the rear compartment is arranged such that its lower edge is arranged behind the stop lugs 92 the hatch is allowed to open rearwardly for allowing the bulk product in the front compartment to exit the front compartment into the rear compartment. However. as long as the rear compartment is filled with the bulk product up to level with the lower edge of the hatch 93, the pressure from behind exercised by the bulk product in the rear compartment on the hatch 93 will prevent the hatch from opening. Thereby the front compartment will be kept filled with clearly visible bulk product until the rear compartment is about to run out of product and the product level decreases below the bottom edge of the hatch 93. When this level is reached in the rear compartment, additional dispensing through the outlet valve will allow also the product from the front compartment to flow into the rear compartment and thereafter to be dispensed through the outlet valve. At this mode of operation, also the bulk product stored in the front compartment for display purposes may be dispensed and sold to customers.

At another mode of operation the hatch 93 is positioned such that its lower edge is arranged in front of the stop lugs 92*a* when the rear and front compartments are filled. At this mode of operation the hatch will be kept closed also when the level of bulk product is lower than the lower edge of the hatch 93 and also when the rear compartment is completely empty. This mode of operation may be preferred when it is desired that the front compartment always should communicate that the gravity feed dispenser is completely full also when the rear compartment is empty or almost empty. For emptying the front compartment an operator reaches by hand into the main compartment and opens the hatch 93 by grabbing a grip (not shown) arranged at the rear side of the hatch.

The easily mountable and dismountable intermediate wall piece 90 provided at this embodiment thus allows for that the user freely may chose whether or not the gravity feed dispenser should be used with or without a so called false front.

The invention has mainly been described above with reference to a few embodiments. However, as is readily appreciated by a person skilled in the art, other embodiments than the ones disclosed above are equally possible within the scope of the invention, as defined by the appended patent claims.

What is claimed is:

1. A gravity feed dispenser for bulk products comprising;

a container (10) arranged for holding the bulk product and comprising an upper inlet opening (12), a lower outlet opening (14) and a plurality of walls comprising side walls (21, 22, 23) and a downwardly sloping bottom wall (24), said walls defining an interior space (16) for receiving the bulk product; and a pivotal outlet valve member (42), which is connected to a pivotal handle (46) and arranged at the outlet opening for selectively allowing and preventing outward flow of the bulk product through the outlet opening by manual pivotal operation of the handle, wherein the container (10) comprises a body (20) and a front piece (30), which body comprises two mutually opposing first sidewalls, (21, 22) a second sidewall forming a rear wall (23) and a forwardly sloping bottom wall (24) and wherein the front piece (30) forms a third side wall and is arranged releasably fixed to a front portion of the body (20) and the outlet valve member (42) is connected to the handle (46) by at least one cylindrical shaft (47) characterized in that the at least one cylindrical shaft (47) is pivotally received between a first semi circular recess (27) arranged in the body (20) and a second semi circular recess (37) arranged in the front piece (30).

2. A gravity feed dispenser according to claim 1, wherein the outlet valve member (42) is connected to the handle by two cylindrical shafts (47), each shaft being pivotally received between pairs of first (27) and second (37) semi circular recesses arranged in the body (20) and front piece (30) respectively.

3. A gravity feed dispenser according to claim 2, wherein the two cylindrical shafts (47) are arranged at opposing lateral ends of the outlet valve member (42).

4. A gravity feed dispenser according to claim 1, wherein the at least one cylindrical shaft defines the pivotal axis for the pivotal outlet member (42) and the pivotal handle.

5. A gravity feed dispenser according to claim 1, wherein the pivotal outlet valve member (42) and the pivotal handle (46) are formed in one single integral piece forming a valve shutter (50).

6. A gravity feed dispenser according to claim 1, wherein the first semi circular recess or recesses (27) is/are arranged in a front edge of a first side wall (21, 22) of the body (20).

7. A gravity feed dispenser according to claim 1, wherein the second semi circular recess or recesses (37) is/are arranged in a rear edge of a first side wall portion (31, 32) of the front piece (30).

8. A gravity feed dispenser according to claim 1, wherein the body (20) exhibits an open front (26) extending between front edges of the first side walls (21, 22).

9. A gravity feed dispenser according to claim 8, wherein the open front extends over essentially the entire vertical length of the front edges of the first side walls (21, 22).

10. A gravity feed dispenser according to claim 1, wherein the body (20) is formed in one single integral piece of material.

11. A gravity feed dispenser according to claim 1, further comprising an intermediate wall piece (90) which is releasably fixed to the body (20) and arranged to divide the interior space (16) into a rear compartment and a front compartment.

12. A gravity feed dispenser according to claim 11, wherein the intermediate wall piece (90) exhibits a wall portion (91), a lower through opening (92) and a hatch (93) which is pivotally attached to the wall portion (91).

13. A gravity feed dispenser according to claim 1, comprising snap-fit means (21*a*, 22*a*, 31*a*, 32*a*) for releasably fixing the front piece (30) to the body (20).

14. A gravity feed dispenser according to claim 13, wherein the snap-fit means (21*a*, 22*a*, 31*a*, 32*a*) are arranged at an upper front portion of the first side walls (21, 22) and at an upper rear portion of the front piece (30).

15. A gravity feed dispenser according to claim 1, wherein each of the body (20) and the front piece (30) comprises cooperating chute portions (25, 35), which together from an outlet chute arranged downstream of the outlet opening (14).

16. A gravity feed dispenser according to claim 15, wherein the chute portions (25, 35) comprise female (35*b*) and male (25*a*) engagement means for form locking a lower portion of the front piece (30) to the body (20).

17. A gravity feed dispenser according to claim 1, comprising a lid (60) which is hingedly and removably fixed to an upper portion of the body (20) for selectively closing and opening the inlet opening (12).

* * * * *